US007341296B2

(12) United States Patent
Daniel

(10) Patent No.: US 7,341,296 B2
(45) Date of Patent: Mar. 11, 2008

(54) WRAP FOR BUNDLING OBJECTS

(75) Inventor: Dianne C. Daniel, Dublin, OH (US)

(73) Assignee: Handle It LLC, Dublin, OH (US)

( * ) Notice: Subject to any disclaimer, the term of this patent is extended or adjusted under 35 U.S.C. 154(b) by 0 days.

(21) Appl. No.: 11/542,657

(22) Filed: Oct. 3, 2006

(65) Prior Publication Data

US 2007/0063524 A1 Mar. 22, 2007

Related U.S. Application Data

(63) Continuation of application No. 10/268,142, filed on Oct. 10, 2002, now Pat. No. 7,192,069, which is a continuation of application No. 09/602,169, filed on Jun. 22, 2000, now abandoned, which is a continuation of application No. 09/080,703, filed on May 18, 1998, now Pat. No. 6,113,170, which is a continuation of application No. 08/671,490, filed on Jun. 27, 1996, now Pat. No. 5,853,212.

(51) Int. Cl.
*A63C 11/02* (2006.01)

(52) U.S. Cl. ..... 294/147; 294/141; 294/165; 24/16 R

(58) Field of Classification Search ..... 294/141, 294/146–148, 165, 166, 150; 24/16 R, 30.5 W, 24/30.5 R, 16 PB, 17 AP, 30.5 P, 30.5 T, 24/27, 300, 17, 30.5; 428/364, 372, 373, 428/375, 379, 398

See application file for complete search history.

(56) References Cited

U.S. PATENT DOCUMENTS

| | | | | |
|---|---|---|---|---|
| 2,061,817 | A | | 11/1936 | Van Cleef |
| 2,118,875 | A | | 5/1938 | Windheim |
| 2,530,695 | A | | 11/1950 | Helmert |
| 2,542,601 | A | | 2/1951 | Van Cleef |
| 3,257,054 | A | | 6/1966 | Miesel |
| 3,426,393 | A | | 2/1969 | Mead |
| 3,543,353 | A | | 12/1970 | Meehan |
| 3,564,667 | A | * | 2/1971 | Parrick, III et al. ..... 280/814 |
| 3,757,429 | A | | 9/1973 | Sumino |
| 3,768,711 | A | | 10/1973 | Wilkinson |
| 3,947,927 | A | | 4/1976 | Rosenthal |
| 3,960,302 | A | | 6/1976 | Mazzoni |
| 4,015,762 | A | | 4/1977 | Mendillo |
| 4,120,437 | A | | 10/1978 | Hara |
| 4,463,885 | A | | 8/1984 | Ball et al. |
| 4,483,470 | A | | 11/1984 | Cousins |

(Continued)

FOREIGN PATENT DOCUMENTS

| | | |
|---|---|---|
| WO | WO 97/00117 | 1/1996 |

OTHER PUBLICATIONS

Zippy, no date, Child's toy foam rubber products.

(Continued)

*Primary Examiner*—Dean J Kramer
(74) *Attorney, Agent, or Firm*—Fish & Richardson P.C.

(57) ABSTRACT

The present invention is comprised of an elongate piece of first material having flexible qualities with a flexible strip of second, more rigid, and bendable material enclosed within the first material. The apparatus may be twist-tied around equipment for relatively easy transport.

42 Claims, 2 Drawing Sheets

U.S. PATENT DOCUMENTS

| | | | | |
|---|---|---|---|---|
| 4,484,378 | A | 11/1984 | Kimura et al. | |
| 4,488,748 | A | 12/1984 | Burkes | |
| 4,531,661 | A | 7/1985 | Santy | |
| 4,540,006 | A | 9/1985 | Collis | |
| 4,553,779 | A | 11/1985 | Shortridge | |
| 4,641,454 | A | 2/1987 | Ray et al. | |
| 4,648,414 | A * | 3/1987 | Fox et al. | 132/246 |
| 4,666,417 | A | 5/1987 | Hillman | |
| 4,817,837 | A | 4/1989 | Grover | |
| 4,834,118 | A | 5/1989 | Goeller | |
| 4,856,689 | A | 8/1989 | Shore | |
| 4,915,996 | A | 4/1990 | Curry | |
| D310,909 | S | 10/1990 | Brandtl | |
| 5,054,299 | A | 10/1991 | Maveety | |
| 5,056,820 | A | 10/1991 | Des Prez | |
| 5,104,017 | A | 4/1992 | Vandagriff | |
| 5,190,336 | A | 3/1993 | Palz | |
| 5,199,135 | A | 4/1993 | Gold | |
| 5,234,370 | A | 8/1993 | Shapero et al. | |
| 5,437,401 | A | 8/1995 | Seltzer | |
| 5,468,036 | A | 11/1995 | Brown | |
| 5,498,190 | A | 3/1996 | Ganson | |
| 5,590,422 | A | 1/1997 | Henderson | |
| 5,664,589 | A | 9/1997 | Black | |
| 5,714,211 | A | 2/1998 | Zinbarg et al. | |
| 5,769,994 | A | 6/1998 | Booz et al. | |
| 5,799,672 | A | 9/1998 | Hansbury | |
| 5,916,006 | A | 6/1999 | Ganson | |
| 6,113,170 | A * | 9/2000 | Daniel | 294/147 |

OTHER PUBLICATIONS

Kenmatic Industries, No Date, Hair care foam rubber product.

Actual embodiment of a Toober (cited in publications of underlying patent application by Daniel).

Actual embodiment of a Hair Twirler (cited in publications of underlying patent application by Daniel).

Verified Complaint for Damages and Injunctive Relief Jury Demand Endorsed Hereon and Civil Cover Sheet, Nov. 25, 2003.

Motion for Temporary Restraining Order and Preliminary Injunction, Nov. 25, 2003.

Defendant Kwiktwist Corporation's Answer, Affirmative Defenses, and Counterclaims, Dec. 18, 2003.

Plaintiff Handle It Limited Liability Company's Reply and Affirmative Defenses to Defendant's Counterclaims, Jan. 5, 2004.

Response to Plaintiff's Motion for Temporary Restraining, Jan. 2, 2004.

Order Denying Motion for Temporary Restraining Order and Preliminary Injunction, Feb. 13, 2004.

Reexamination exhibit—photograph of "Hair Twirler" and "Toober" construction toy.

Order Staying All Proceedings, United States District Court, Eastern District of Texas entered into the record on Aug. 17, 2004.

Office Action Mailed Mar. 17, 2006 for U.S. Appl. No. 90/007,077.

*Potts* v. *Creager*, 155, U.S. 597; 15 S. Ct. 194; 39 L. Ed. 275; 1895 U.S. LEXIS 2109 (1895).

*Topliff* v. *Topliff and Another*, 145 U.S. 156; 12 S. Ct. 825,; 36 L. Ed. 658; 1892 U.S. LEXIS 2128 (1892).

*Hobbs* v. *Beach*, 180 U.S. 383; 21 S. Ct. 409; 45 L. Ed. 586; 1901 U.S. LEXIS (1901).

*Traitel Marble Co.* v. *U.T. Hungerford Brass & Copper Co.*, 18 F.2d 66; 1927 U.S. App. LEXIS 1877 (2d Cir. 1927).

*H.C. White Co.* v. *Morton E. Converse & Son Co.*, et al., 20 F.2d 311; 1927 U.S. App. LEXIS 2518 (2d Cir. 1927).

In Re Hans Oetiker, 977 F.2d 1443; 1992 U.S. App LEXIS 25784; 24 U.S.P.Q.2d (BNA) 1443; 93 Daily Journal DAR 658 (1992).

Amendments by Patent Owner in Ex Parte Reexamination filed Apr. 17, 2006 in Reexam U.S. Appl. No. 90/007,077, Reexam filed Jun. 15, 2004.

Declaration by Jeffrey s. Standley filed in support of Amendment by Patent Owner in Ex Parte Reexamination filed Apr. 17, 2006 in Reexam U.S. Appl. No. 90/007,077, Reexam filed Jun. 15, 2004.

Affidavit Under 37 C.F.R. § 1.132 of Dianne C. Daniel filed in support of Amendment by Patent Owner in Ex Parte Reexamination filed Apr. 17, 2006 in Reexam U.S. Appl. No. 90/007,077, Reexam filed Jun. 15, 2004.

* cited by examiner

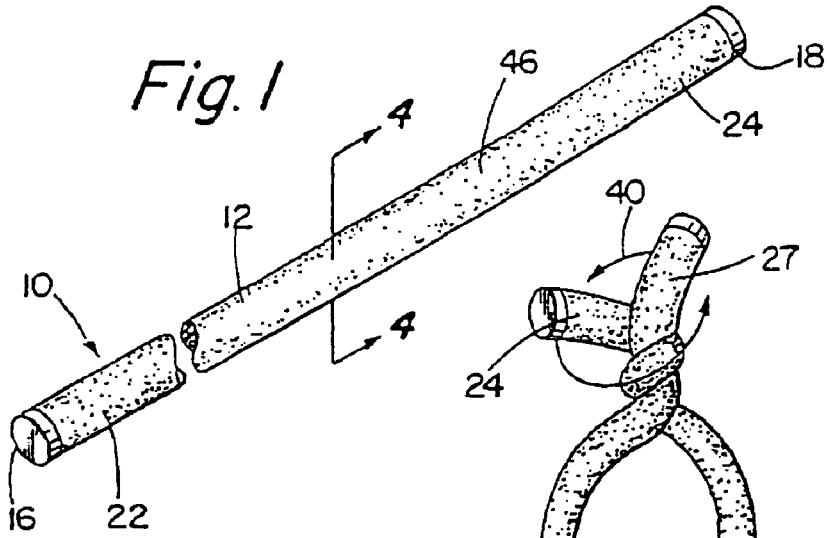
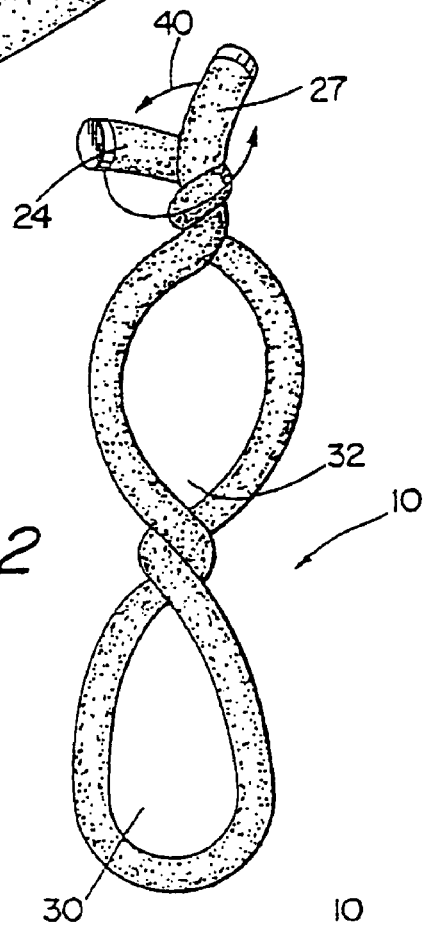
Fig. 2
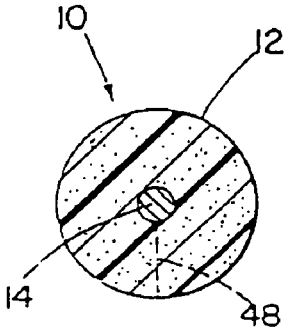
Fig. 4
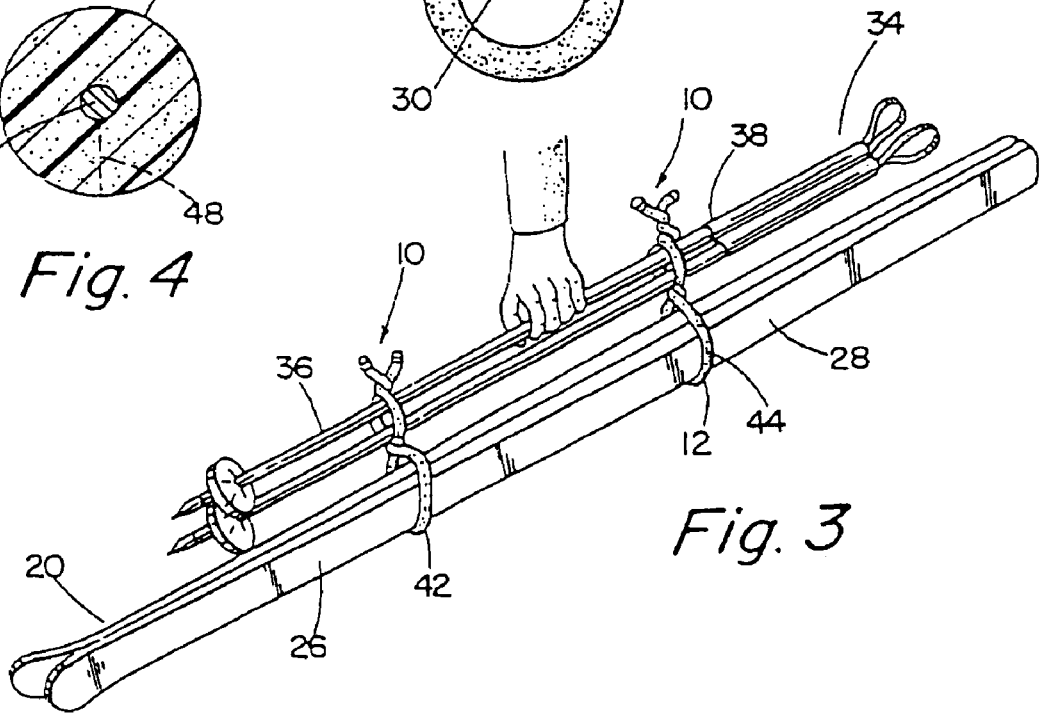
Fig. 3

WRAP FOR BUNDLING OBJECTS

This is a continuation of U.S. application Ser. No. 10/268,142, filed on Oct. 10, 2002 now U.S. Pat. No. 7,192,069, which is a continuation of U.S. application Ser. No. 09/602,169, filed Jun. 22, 2000 now abandoned, which is a continuation of U.S. application Ser. No. 09/080,703, filed May 18, 1998, now U.S. Pat. No. 6,113,170, which is a continuation of U.S. application Ser. No. 08/671,490, filed Jun. 27, 1996, now U.S. Pat. No. 5,853,212. The entirety of each of these references is hereby incorporated by reference.

BACKGROUND AND SUMMARY OF THE INVENTION

The present invention relates generally to equipment transportation devices and methods, and more particularly, to a snow ski wrap for easy transport of snow ski equipment.

The joys of snow skiing can often be shadowed by the difficulties of carrying and transporting the heavy and bulky skis and ski poles. Known ski equipment carrying devices such as those disclosed in U.S. Pat. Nos. 3,960,302, 4,888,748, 2,530,695, 3,257,054, 5,468,036, 2,118,875, 3,768,711, 4,120,437, 4,463,885, 4,015,762, 4,856,689, 5,190,336, 5,437,401, 4,531,661, and 3,947,927 require some sort of elaborate buckling, strapping, or Velcro-connecting means for carrying ski equipment. All these known devices are lacking because:

1) they require relatively time-consuming construction prior to use;
2) they cannot be easily used while wearing heavy snow gloves;
3) they are all relatively detailed in construction;
4) some fail to secure the ski equipment while also preventing scratch damage to the equipment; and
5) many known devices are not easily stored on the person while skiing.

The present invention is comprised of a tube-like, elongate piece of first material having characteristics including, but not limited to, soft, lightweight, and flexible qualities, such as found in sponge (or foam) rubber (any variation of first materials of the rubber-like variety would work well depending on the application and/or particular manufacturing technique). The tube-like, elongate piece of first material encloses a flexible strip of second material having characteristics including, but not limited to, flexible qualities that allow the strip to retain its new shape when bent, such as a flexible wire. In an exemplary embodiment, the tube-like, elongate piece of first material is a sponge (or foam) rubber piece which can be easily grabbed, or handled, while wearing heavy ski gloves. The flexible strip is bendable which allows the elongate rubber piece to retain its shape when bent. The elongate rubber piece is then twisted together to secure the snow skis. A second ski wrap may be similarly used to secure the opposite end of the snow skis. A pair of ski poles may then be placed in the spaces formed by the twisting of the ski wraps securing the snow skis. The ski wraps may again be twisted to secure the ski poles in place. The skier may then grab the ski poles and easily transport the ski equipment.

The rubber material preferably has a non-slip exterior surface which allows the ski equipment to be secured within the invention. Additionally, the rubber wrap does not scratch the expensive ski equipment while in contact with the equipment. The rubber wrap also slightly elevates the ski equipment from the ground which prevents damage to the ski equipment by abrasive asphalt or gravel.

The efficient design of the snow ski wrap allows for relatively easy manufacture. The design of the present invention also allows for easy maintenance and storage of the ski wrap when not in use. When not in use, the present invention may be stored in a user's pocket while skiing.

The present invention provides a much-needed apparatus and method of easily securing and carrying ski equipment as well as other apparatus. In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art, from a reading of the following detailed description in conjunction with the accompanying drawings wherein similar reference characters refer to similar parts and in which:

FIG. 1 is a perspective view of an exemplary embodiment of the apparatus of the present invention;

FIG. 2 is a plan view of the apparatus of FIG. 1 in a twisted shape;

FIG. 3 is a perspective view of the apparatus of FIG. 1 in use;

FIG. 4 is a cross sectional taken along lines 4-4 in FIG. 1;

DETAILED DESCRIPTION OF THE EXEMPLARY EMBODIMENTS

Figure 5:
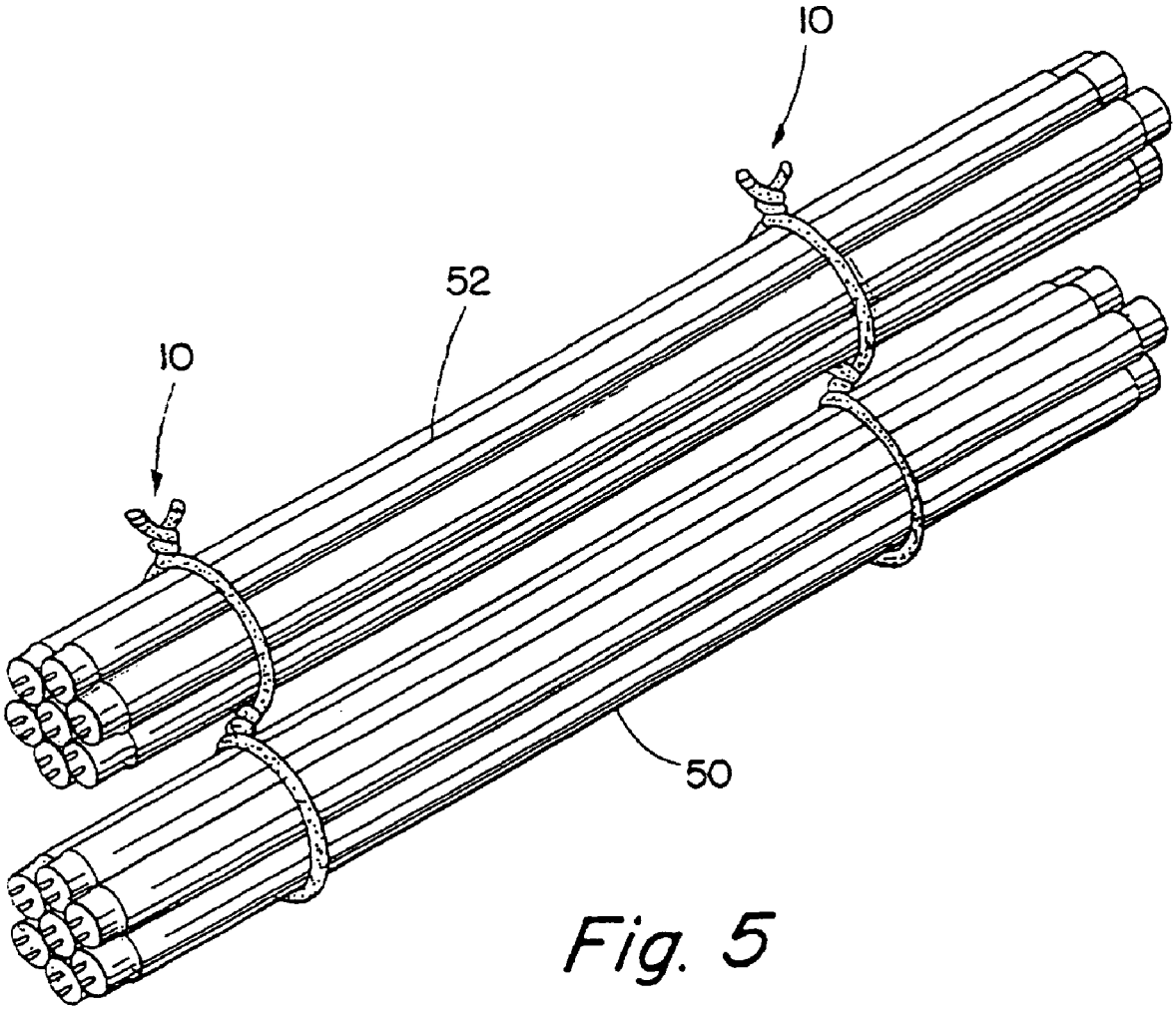
FIG. 5 is a perspective view of an exemplary embodiment of the present invention in use as a bundling apparatus.

An exemplary system herein described is not intended to be exhaustive or to limit the invention to the precise forms disclosed. They are chosen and described to explain the principles of the invention, and the application of the method to practical uses, so that others skilled in the art may practice the invention.

The present invention is comprised of a tube-like, elongate piece of first material 12 having characteristics including, but not limited to, soft, lightweight, and flexible qualities, such as found in sponge (or foam) rubber (any variation of first materials of the rubber-like variety would work well depending on the application and/or particular manufacturing technique). The tube-like, elongate piece 12 of first material encloses a flexible strip 14 of second material having characteristics including, but not limited to, flexible qualities that allow the strip 14 to retain its new shape when bent, such as a flexible wire. In an exemplary embodiment, the tube-like, elongate piece 12 of first material is a sponge (or foam) rubber piece 12, and the flexible strip 14 of second material is a strip 14 of flexible metal.

Referring in more detail to the drawings, and particularly FIG. 1, an exemplary embodiment of the snow ski wrap 10 of the present invention is comprised of a tube-like, elongate piece of sponge, or foam, rubber 12, a strip 14 of flexible metal enclosed within the length of the elongate piece of foam rubber 12, and a first end cap 16 placed over the first end 22 of the elongate piece of foam rubber 12, and a second end cap 18 placed over the opposite end 24 of the elongate piece of foam rubber 12.

It may be preferred that the elongate piece of foam rubber 12 be formed of a long tube-like form, preferably between 10 to 50 inches long, as illustrated in FIG. 1. It may also be preferred that the elongate piece of foam rubber 12 have a diameter between 0.5 inch to 2.5 inches so that the snow ski wrap 10 is capable of being easily grabbed and manipulated while a user is wearing heavy ski gloves. Several well known manufacturing methods may be used to produce the present invention. An exemplary method is to co-extrude the rubber piece 12 onto the flexible strip 14.

The flexible strip 14 of metal can be easily bent, yet the strip 14 has a degree of rigidity which allows the snow ski wrap 10 to retain its form when bent or straightened. In an exemplary embodiment, the strip 14 is a solid, 14 gauge, wire. FIG. 4 illustrates a cross-section of one end of the ski wrap 10, showing the enclosed strip 14 of wire.

The ski wrap 10 may be used by straightening the foam rubber piece 12 as illustrated in FIG. 1. Next the skier may place the two skis 20 together, as illustrated in FIG. 3. The skier may then take the ski wrap 10 of the present invention and grab the ends 22, 24 of the foam rubber piece 12 and wrap the elongate piece of foam rubber 12 around the first ends 26 of the two skis 20. The skier/user may then "twist-tie" the foam rubber piece 12 around the first ends 26 of the two skis. Twist-tying refers to interlocking the foam rubber piece 12 by twisting the ends 22, 24 of the foam rubber piece 12 together in the direction of the arrows 40 in FIG. 2. (The ends 22, 24 can also be twisted in the opposite direction of the arrows 40).

The skier/user may then wrap and twist-tie a second ski wrap 10 around the second ends 28 of the skis 20. This twist-tying motion creates a loop or hole 30 in which the skis 20 are secured. This twist-tying motion may also create a space 32 in which the ski poles 34 can be placed. The skier/user may then place a pair of ski poles 34 in the space 32 formed by the twist-tying of the elongate pieces of foam rubber 12. The ski poles 34 may be secured in place by wrapping and twist-tying the elongate pieces of foam rubber 12 a second time around the ends 36, 38 of the pair of ski poles 34.

The skier/user may carry the ski equipment by grasping the ski poles 34 between the first and second elongate pieces of foam rubber (42, 44 respectively).

The present invention is also unique as the elongate piece of foam rubber 12 has a non-slip exterior 46 in contact with the skis 20 and ski poles 34. The non-slip exterior 46 firmly secures the ski equipment in place to prevent the equipment from falling out of the loops 30. The foam rubber also protects the ski equipment from being scratched by the carrying means. Other known ski carrying equipment utilize straps made of leather, or other material, which can scratch the surface of the ski equipment. In the present invention, the insulation provided by the foam rubber protects the finished surfaces of the ski equipment from damage while in transit. Not only does the present invention prevent scratching from the ski carrier, the snow ski wrap 10 may be used to keep the snow skis 20 off the abrasive ground or pavement. A snow ski wrap 10 is preferably made with a foam rubber piece 12 with a radius 48 large enough to elevate the skis 20 off the hard ground.

The present invention has other beneficial uses. More particularly, the present invention is capable of being used for bundling and carrying elongate articles. For example, the present invention 10 is capable of separately bundling rods, baseball bats, sticks of wood, garden hoses or practically any other elongate article.

As illustrated, the present invention 10 may be used to bundle articles in separate groups. For example, as illustrated by FIG. 5, the first loop may be used to bundle and carry rods of one type 50 while the second loop may be used to bundle and carry rods of a second type 52. The present invention 10 is unique as it may be easily grabbed and manipulated while wearing heavy gloves. Additionally, the foam rubber exterior 46 preferably protects the bundled articles from being scratched by the carrying means. As discussed above, the foam rubber may also insulate the bundled elongate articles, such as the rods 50, 52 illustrated in FIG. 5, from damage when placed on the ground.

Figure 6:
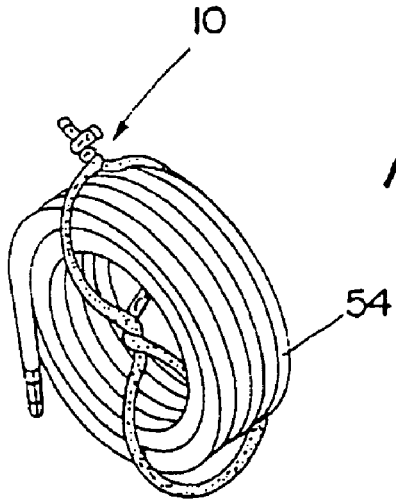
FIG. 6 is a perspective view of an exemplary embodiment of the present invention in use as a garden hose restraint and carrying means.

FIG. 6 illustrates the present invention in use as a garden hose 54 restraint and carrying means. The present invention may also be used to secure items in place. For example, the present invention may be used to secure a bicycle to a bike rack.

Having shown and described an exemplary embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. An apparatus for securing an elongate article to an adjacent article, comprising:

first means for storing or transporting an elongate article with an adjacent article, said first means for storing or transporting including first means for bendably wrapping around a first portion of the elongate article in a non-slip, soft, and non-scratch engagement and for twisting-tying the elongate article to the adjacent article; and second means for storing or transporting the elongate article with the adjacent article, said second means for storing or transporting including second means for bendably wrapping around a second portion of the elongate article in a non-slip, soft, and non-scratch engagement and for twisting-tying the elongate article to the adjacent article, wherein the first and second means for storing or transporting are first and second means for storing or transporting garden equipment.

2. The apparatus of claim 1, wherein the first and second means for bendably wrapping and twisting-tying allow hand-grasping of the first and second means for storing or transporting while wearing heavy gloves.

3. The apparatus of claim 1, wherein the elongate article comprises a coil of a garden hose and wherein the adjacent article comprises another coil of the garden hose.

4. The apparatus of claim 1, wherein the first means for bendably wrapping and twisting-tying comprises a first elongate piece of rubber-like material selected from the group consisting of foam rubber and sponge rubber.

5. The apparatus of claim 4, wherein the first means for storing or transporting comprises a first strip of bendable metallic material and the first elongate piece of rubber-like material, the first strip of bendable metallic material being enclosed within the first elongate piece of rubber-like material.

6. The apparatus of claim 5, wherein the second means for bendably wrapping and twisting-tying comprises a second elongate piece of rubber-like material selected from the group consisting of foam rubber and sponge rubber.

7. The apparatus of claim 6, wherein the second means for storing or transporting comprises a second strip of bendable metallic material and the second elongate piece of rubber-like material, the second strip of bendable metallic material being enclosed within the second elongate piece of rubber-like material.

8. The apparatus of claim 7, wherein the first and second means for storing or transporting each have a diameter between about 0.5 inch and about 2.5 inches and each have a length of at least about 10 inches.

9. The apparatus of claim 1, wherein the first means for bendably wrapping and twisting-tying comprises an elongate piece of soft foam material that abuts a strip of wire.

10. The apparatus of claim 9, wherein the elongate piece of soft foam material is co-extruded onto the strip of wire.

11. The apparatus of claim 9, wherein the elongate piece of soft foam material engages the strip of wire without an intermediate layer therebetween.

12. An apparatus for securing an elongate article to an adjacent article, comprising:

a bendable elongate device that is wrapped around recreational equipment in a non-slip, soft, and non-scratch engagement;

the bendable elongate device being wrapped around equipment that is adjacent to the recreational equipment in a non-slip engagement;

the bendable elongate device comprising a strip of bendable metal wire enclosed by an elongate piece of soft foam material selected from the group consisting of foam rubber and sponge rubber, the bendable elongate device having a degree of rigidity so as to retain its form when bent or straightened, and the bendable device having a diameter between about 0.5 inch and about 2.5 inches and having a length of at least about 10 inches; and the bendable elongate device comprising free ends that are twist-tied so as to secure the recreational equipment to the adjacent equipment.

13. The apparatus of claim 12, wherein the recreational equipment comprises a first ski equipment and wherein the adjacent equipment comprises a second ski equipment.

14. The apparatus of claim 12, wherein the recreational equipment comprises a bicycle and wherein the adjacent equipment comprises a rack to receive the bicycle.

15. The apparatus of claim 12, wherein the bendable elongate device further comprises a first end cap arrange on one of the free ends and a second end cap arranged on another one of the free ends.

16. The apparatus of claim 15, wherein the elongate piece of soft foam material has a tubular shape having a length of at least 10 inches to about 50 inches, and wherein the bendable metal wire comprises a solid wire having a thickness of about 14 gauge.

17. The apparatus of claim 12, further comprising a second bendable elongate device that is wrapped around recreational equipment in a non-slip, soft, and non-scratch engagement and that is wrapped around the adjacent equipment in a non-slip engagement.

18. The apparatus of claim 17, wherein the second bendable elongate device comprises a strip of bendable metal wire enclosed by an elongate piece of soft foam material selected from the group consisting of foam rubber and sponge rubber, the second bendable elongate device having a degree of rigidity so as to retain its form when bent or straightened, and the bendable device having a diameter between about 0.5 inch and about 2.5 inches and having a length of at least about 10 inches.

19. The apparatus of claim 18, wherein the second bendable elongate device comprises free ends that are twist-tied so as to secure the recreational equipment to the adjacent equipment.

20. The apparatus of claim 12, wherein the elongate piece of soft foam material abuts the strip of wire.

21. The apparatus of claim 20, wherein the elongate piece of soft foam material co-extruded onto the strip of wire.

22. The apparatus of claim 20, wherein the elongate piece of soft foam material engages the strip of wire without an intermediate layer therebetween.

23. An apparatus for securing an elongate article to an adjacent article, comprising:

first means for storing or transporting an elongate article with an adjacent article, said first means for storing or transporting including first means for bendably wrapping around a first portion of the elongate article in a non-slip, soft, and non-scratch engagement and for twisting-tying the elongate article to the adjacent article; and second means for storing or transporting the elongate article with the adjacent article, said second means for storing or transporting including second means for bendably wrapping round a second portion of the elongate article in a non-slip, soft, and non-scratch engagement and for twisting-tying the elongate article to the adjacent article, wherein the first and second means for storing or transporting are first and second means for storing or transporting recreational equipment, and wherein the elongate article comprises a first ski equipment and wherein the adjacent article comprises a second ski equipment.

24. The apparatus of claim 23, wherein the first and second means for bendably wrapping and twisting-tying allow hand-grasping of the first and second means for storing or transporting while wearing heavy gloves.

25. The apparatus of claim 23, wherein the first means for bendably wrapping and twisting-tying comprises a first elongate piece of rubber-like material selected from the group consisting of foam rubber and sponge rubber.

26. The apparatus of claim 25, wherein the first means for storing or transporting comprises a first strip of bendable metallic material and the first elongate piece of rubber-like material, the first strip of bendable metallic material being enclosed within the first elongate piece of rubber-like material.

27. The apparatus of claim 26, wherein the second means for bendably wrapping and twisting-tying comprises a second elongate piece of rubber-like material selected from the group consisting of foam rubber and sponge rubber.

28. The apparatus of claim 27, wherein the second means for storing or transporting comprises a second strip of bendable metallic material and the second elongate piece of rubber-like material, the second strip of bendable metallic material being enclosed within the second elongate piece of rubber-like material.

29. The apparatus of claim 28, wherein the first and second means for storing or transporting each have a diameter between about 0.5 inch and about 2.5 inches and each have a length of at least about 10 inches.

30. The apparatus of claim 23, wherein the first means for bendably wrapping and twisting-tying comprises an elongate piece of soft foam material that abuts a strip of wire.

31. The apparatus of claim 30, wherein the elongate piece of soft foam material is co-extruded onto the strip of wire.

32. The apparatus of claim 30, wherein the elongate piece of soft foam material engages the strip of wire without an intermediate layer therebetween.

33. An apparatus for securing an elongate article to an adjacent article, comprising:

first means for storing or transporting an elongate article with an adjacent article, said first means for storing or transporting including first means for bendably wrapping around a first portion of the elongate article in a non-slip, soft, and non-scratch engagement and for twisting-tying the elongate article to the adjacent article; and second means for storing or transporting the elongate article with the adjacent article, said second means for storing or transporting including second means for bendably wrapping around a second portion of the elongate article in a non-slip, soft, and non-scratch engagement and for twisting-tying the elongate article to the adjacent article, wherein the first and second means for storing or transporting are first and second means for storing or transporting recreational equipment, and wherein the elongate article comprises a bicycle and wherein the adjacent article comprises a rack to receive the bicycle.

34. The apparatus of claim 33, wherein the first and second means for bendably wrapping and twisting-tying allow hand-grasping of the first and second means for storing or transporting while wearing heavy gloves.

35. The apparatus of claim 33, wherein the first means for bendably wrapping and twisting-tying comprises a first elongate piece of rubber-like material selected from the group consisting of foam rubber and sponge rubber.

36. The apparatus of claim 35, wherein the first means for storing or transporting comprises a first strip of bendable metallic material and the first elongate piece of rubber-like material, the first strip of bendable metallic material being enclosed within the first elongate piece of rubber-like material.

37. The apparatus of claim 36, wherein the second means for bendably wrapping and twisting-tying comprises a second elongate piece of rubber-like material selected from the group consisting of foam rubber and sponge rubber.

38. The apparatus of claim 37, wherein the second means for storing or transporting comprises a second strip of bendable metallic material and the second elongate piece of rubber-like material, the second strip of bendable metallic material being enclosed within the second elongate piece of rubber-like material.

39. The apparatus of claim 38, wherein the first and second means for storing or transporting each have a diameter between about 0.5 inch and about 2.5 inches and each have a length of at least about 10 inches.

40. The apparatus of claim 33, wherein the first means for bendably wrapping and twisting-tying comprises an elongate piece of soft foam material that abuts a strip of wire.

41. The apparatus of claim 40, wherein the elongate piece of soft foam material is co-extruded onto the strip of wire.

42. The apparatus of claim 40, wherein the elongate piece of soft foam material.

* * * * *

UNITED STATES PATENT AND TRADEMARK OFFICE

CERTIFICATE OF CORRECTION

PATENT NO. : 7,341,296 B2
APPLICATION NO. : 11/542657
DATED : March 11, 2008
INVENTOR(S) : Dianne C. Daniel It is certified that error appears in the above-identified patent and that said Letters Patent is hereby corrected as shown below:

Column 8, line 30, after "material" please insert --engages the strip of wire without an intermediate layer therebetween--.

Signed and Sealed this

Twenty-sixth Day of August, 2008

JON W. DUDAS
*Director of the United States Patent and Trademark Office*